US012668982B2

(12) United States Patent
Walters

(10) Patent No.: US 12,668,982 B2
(45) Date of Patent: Jun. 30, 2026

(54) FORMLINER SYSTEM WITH CARRIER

(71) Applicant: ARCHITECTURAL POLYMERS LLC, Palmerton, PA (US)

(72) Inventor: Marshall Gilbert Walters, Lehighton, PA (US)

(73) Assignee: ARCHITECTURAL POLYMERS, LLC, Palmerton, PA (US)

( * ) Notice: Subject to any disclaimer, the term of this patent is extended or adjusted under 35 U.S.C. 154(b) by 309 days.

(21) Appl. No.: 18/631,264

(22) Filed: Apr. 10, 2024

(65) Prior Publication Data

US 2024/0344341 A1 Oct. 17, 2024

Related U.S. Application Data

(60) Provisional application No. 63/495,565, filed on Apr. 12, 2023.

(51) Int. Cl.
*E04G 9/10* (2006.01)

(52) U.S. Cl.
CPC ..... *E04G 9/10* (2013.01)

(58) Field of Classification Search
CPC ..... E04G 9/10; E04G 21/142; E04G 15/04; B28B 19/0061; B28B 19/0069; B28B 7/0073; B28B 23/005; B29D 99/0014; B29D 99/0017; B66C 1/666
USPC ..... 249/112
See application file for complete search history.

(56) References Cited

U.S. PATENT DOCUMENTS 2,339,489 A * 1/1944 Kublanow ..... B28B 1/52 52/309.1
3,602,476 A * 8/1971 Iragorri ..... E04F 13/0862 425/117
5,002,817 A * 3/1991 Jones ..... E04C 2/30 156/763
5,057,258 A * 10/1991 Scuri ..... B29C 33/40 264/300
5,225,134 A * 7/1993 Nasvik ..... B28B 7/36 264/254
5,232,646 A * 8/1993 Nasvik ..... B28B 7/36 264/254
5,268,137 A * 12/1993 Scott ..... E04G 9/10 264/225
5,372,676 A * 12/1994 Lowe ..... C04B 28/02 264/133
5,386,963 A * 2/1995 Nasvik ..... B28B 7/0073 249/189
5,536,557 A * 7/1996 Nasvik ..... B28B 7/0073 428/156

(Continued)

FOREIGN PATENT DOCUMENTS

GB 2100659 A * 1/1983 ..... B28B 7/364

*Primary Examiner* — Kyle J. Walraed-Sullivan
(74) *Attorney, Agent, or Firm* — McNees Wallace & Nurick LLC

(57) ABSTRACT

A formliner system with a carrier and a method for constructing the formliner system are provided. The formliner system includes a planar support, design layer, and a carrier. The planar support includes at least one support layer. The design layer includes a mold. The design layer overlies and is attached to the planar support. The carrier is integrated into the planar support and includes a sleeve. The sleeve is configured to receive a connector. The carrier is positioned such that the sleeve does not extend proud of a perimeter edge of the formliner.

18 Claims, 8 Drawing Sheets

(56) References Cited

U.S. PATENT DOCUMENTS

| | | | | | |
|---|---|---|---|---|---|
| 5,632,922 | A * | 5/1997 | Nasvik | B28B 7/0073 | 249/44 |
| D380,139 | S * | 6/1997 | Scott | D8/349 | |
| 5,637,236 | A * | 6/1997 | Lowe | B28B 11/0818 | 216/99 |
| 5,667,190 | A * | 9/1997 | Scott | E04G 17/00 | 52/312 |
| 6,059,257 | A * | 5/2000 | Scott, III | E04G 9/10 | 249/97 |
| 6,129,329 | A * | 10/2000 | Nasvik | B28B 7/36 | 249/189 |
| 6,186,469 | B1 * | 2/2001 | Scott | E04G 9/10 | 249/16 |
| 7,871,054 | B2 | 1/2011 | Walters | | |
| 2003/0085481 | A1 * | 5/2003 | Nasvik | B28B 7/0073 | 249/189 |
| 2009/0235600 | A1 * | 9/2009 | Logan | B28B 13/0275 | 264/232 |
| 2011/0056165 | A1 * | 3/2011 | Charles, Jr. | B28B 7/0026 | 52/745.19 |
| 2011/0073747 | A1 * | 3/2011 | Walters | E04G 9/10 | 249/160 |
| 2011/0132533 | A1 * | 6/2011 | Kogl | E04G 9/02 | 249/112 |
| 2015/0069211 | A1 * | 3/2015 | Calmes | B28B 7/364 | 249/15 |
| 2016/0010346 | A1 * | 1/2016 | Calmes | B28B 19/0061 | 249/15 |

* cited by examiner

FORMLINER SYSTEM WITH CARRIER

CROSS-REFERENCE TO RELATED APPLICATIONS

This application claims the benefit of, and priority to, U.S. Provisional Patent Application Ser. No. 63/495,565, filed on Apr. 12, 2023, the content of which is incorporated herein by reference in its entirety.

FIELD OF DISCLOSURE

The present disclosure relates to a formliner system with a carrier and more particularly to a formliner system having an integrated carrier.

BACKGROUND

Architectural designs for various types of construction call for the use of concrete for decorative architectural purposes. There are a number of exterior architectural molding choices available on the market for various sidings utilizing ornate concrete moldings.

Formliners are molds for giving decorative designs onto concrete surfaces. Compared to a traditional way of pouring concrete and applying a texturing tool, a formliner is attached to a form and concrete is poured onto it. Formliners have been widely used for many years for structures such as highway walls and sound barriers.

Existing formliner systems generally include multiple wooden support layers in order to withstand the tremendous weight of concrete that is received in the mold during casting of walls or wall segments. This in turn can result in the formliner itself being very heavy, in some cases up to several thousand pounds for those used in forming large walls, and making them difficult to carry or manipulate without forklifts or other mechanical equipment. Even careful operation of such equipment can still pose a risk of damaging the formliner and rendering it unfit for use and safety.

Therefore, there remains a need for a formliner system that can more easily be moved from one place to another.

SUMMARY

The present disclosure describes various exemplary systems and methods of creating a formliner system that has an integrated carrier built into the formliner. The carrier can be used for mechanical equipment to engage with the formliner in a manner that significantly reduces the risk of damage.

In an exemplary embodiment, a formliner system includes a planar support, a design layer, and a carrier integrated within the support layer. The design layer includes a mold, and the design layer overlies and is attached to the planar support. The carrier is integrated into the planar support, and the carrier includes a sleeve. In some embodiments the sleeve is configured to receive a connector and some embodiments the carrier is positioned such that the sleeve does not extend proud of a perimeter edge of the formliner.

In another exemplary embodiment, a formliner system includes a first support layer, a second support layer, a design layer, and a carrier. The second support layer overlies and is attached to the first support layer. The design layer includes a rubber mode, and the design layer overlies and is attached to the second support layer. The carrier is interposed between the first and second support layers, and the carrier is attached to at least one of the first or second support layers. The carrier includes a sleeve, which is configured to receive a connector. The carrier also includes a brace plate, which is attached to the sleeve. The carrier is positioned such that the sleeve does not extend proud of a perimeter of the formliner. The carrier is positioned in a recess formed in either one or both of the first and second support layers.

In another exemplary embodiment, a method of creating a formliner system includes steps of creating a formliner system with a carrier. The steps include (i) providing a first support layer, a second support layer, and a carrier that includes a sleeve, which is configured to receive a connector; (ii) securing the carrier in a recess formed in the first support layer; (iii) attaching the second support layer overlying the first support layer to form a planar support such that the carrier is interposed between the first and second support layers; and (iv) forming a mold as a design layer overlying the planar support such that the sleeve is not proud of a perimeter edge of the formliner.

Other features and advantages of the present invention will be apparent from the following more detailed description of exemplary embodiments, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION

Provided herein is an exemplary formliner system. Example embodiments of the present disclosure provide for a formliner system for easier carrying, especially in conjunction with mechanical equipment.

Figure 1A:
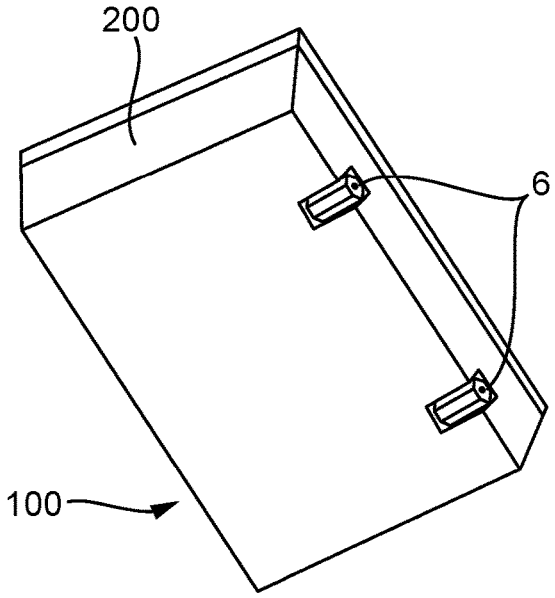
FIGS. 1A-1C are perspective views of an exemplary formliner system.
Figure 1B:
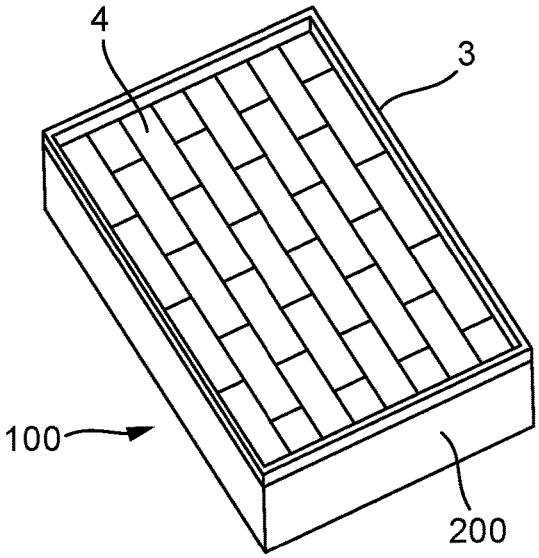

Referring to FIGS. 1A-1B, in one example embodiment, a formliner system 100 with a carrier 6 is shown. The formliner system 100 includes a planar support 200, a design layer 3, and two carriers 6 integrated into the planar support 200 along a same side edge. The design layer 3 provides a mold 4 on which concrete or another setting material can be poured during formliner 100 use within a form to impart a design to a surface of a wall or wall segment being formed using the formliner 100. The design layer 3 overlies the planar support 200 and is attached to the planar support 200.

Figure 1C:
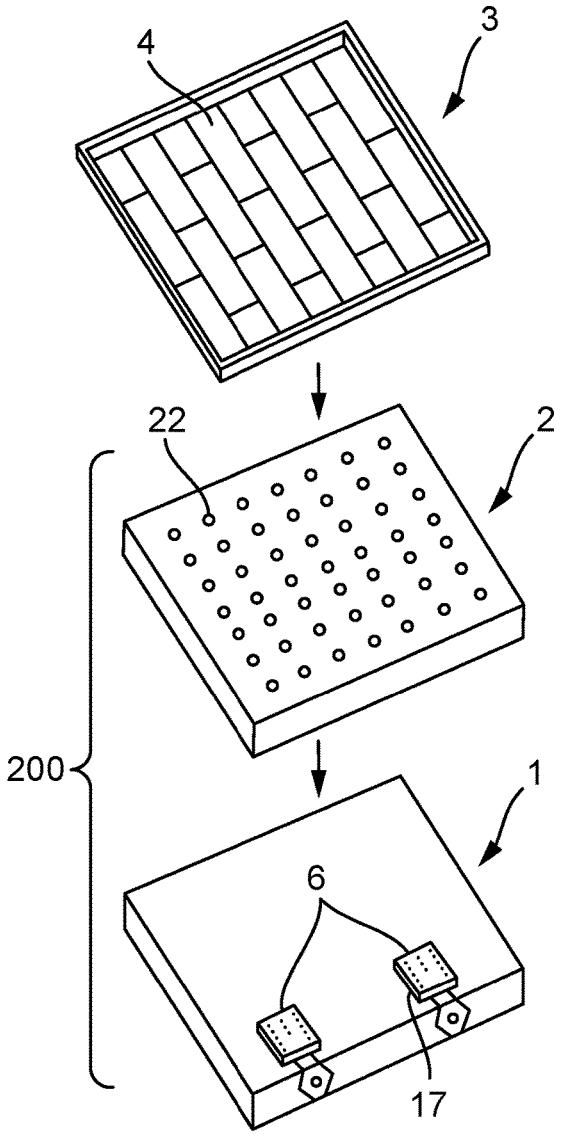

Referring to FIG. 1C, the planar support 200 comprises a first support layer 1 and a second support layer 2 in which the two carriers 6 are interposed between the first and second support layers 1, 2 so as to be integrated with the planar support 200. Although shown and described with respect to two support layers, it will be appreciated that alternatively a single support layer may be used or that more than two support layers may be employed.

During construction, the first support layer 1 may be formed with one or more recesses 17 so that the carriers 6 are positioned in the recesses 17 of the first support layer 1 and are subsequently attached thereto. The second support layer 2 is then placed to overlie the first support layer 1 and the carriers 6 and is attached thereto. The design layer 3 overlies the second support layer 2 and may be formed thereon before or after that layer is attached to the first support layer 1. The carriers 6 are integrated into the formliner system 100 and are interposed between the first and second support layers 1, 2 that form the planar support 200.

The first and second support layers 1, 2 can be made from any suitable material for the support required and preferably are made from plywood. Various types of plywood may be employed, including weather-resistant versions, such as, but not limited to, marine plywood and CDX plywood. The support layers 1, 2 may be attached to one another in any suitable fashion, including chemically, mechanically, or a combination in accordance with existing formliner manufacturing techniques.

Figure 2:
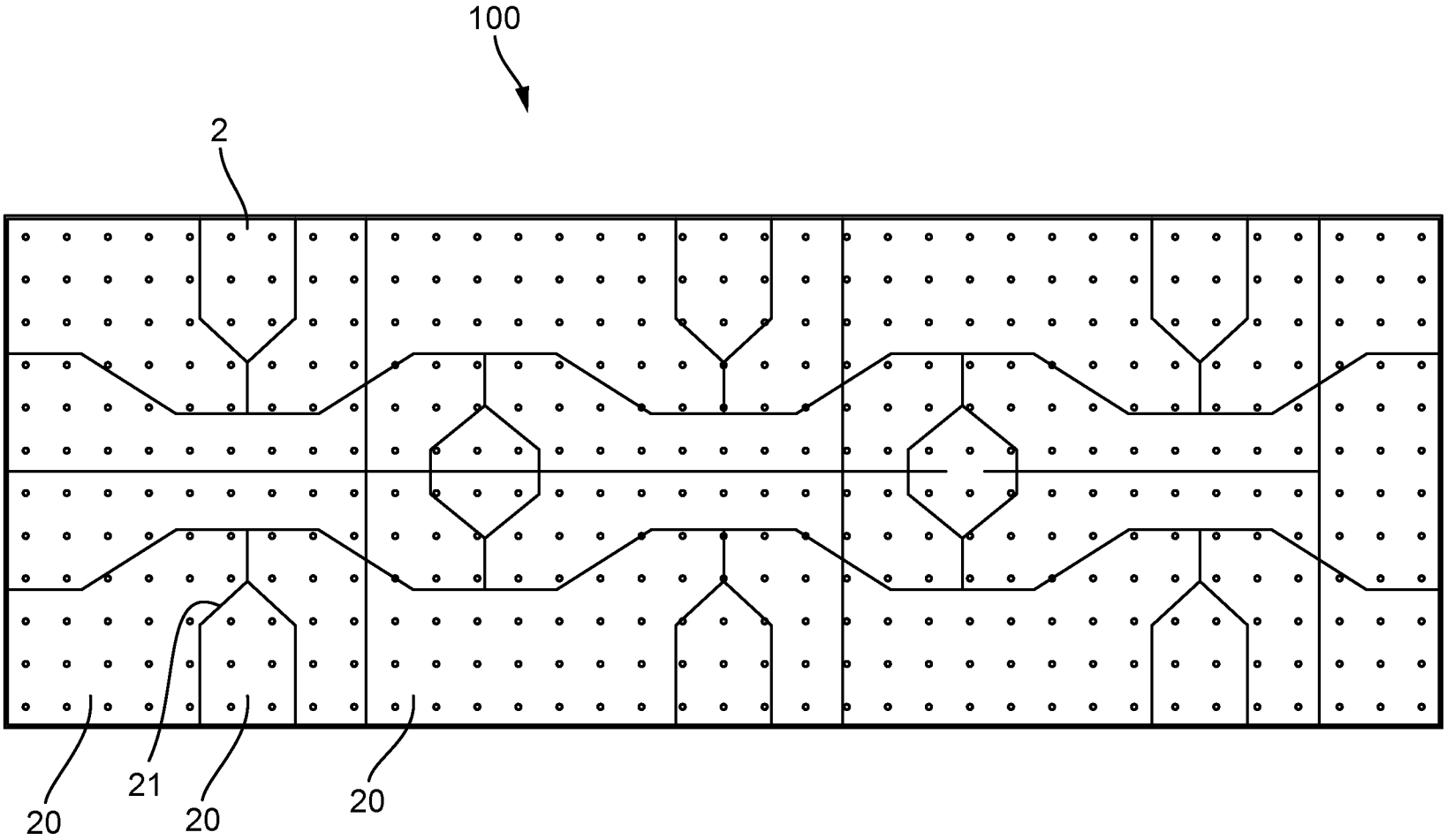
FIG. 2 is a top view of a second support layer of an exemplary formliner system.

It will be appreciated that the first and/or second support layers 1, 2 may be made of a monolithic piece of material or may be constructed from one or more segments 20 that are assembled together, as shown in FIG. 2. In embodiments in which both the first and/or second support layers 1, 2 of the formliner system 100 are assembled from multiple segments 20, it may be desirable to stagger the joints 21 so the joints 21 of an upper layer do not substantially overlap that of a lower layer.

The design layer 3 is preferably made from an elastic material, such as rubber, to provide a rubber mold 4. The rubber material may include, but is not limited to, urethane and latex. The second support layer 2 may include bleeding holes 22 which can aid in securing the design layer 3 to the second support layer 2 when liquid rubber is poured to initially form the design layer 3. Any design that is desired to be imparted to a wall surface may be used to form the mold 4 of the design layer 3 in the same manner as conventional formliner construction.

Figure 3A:
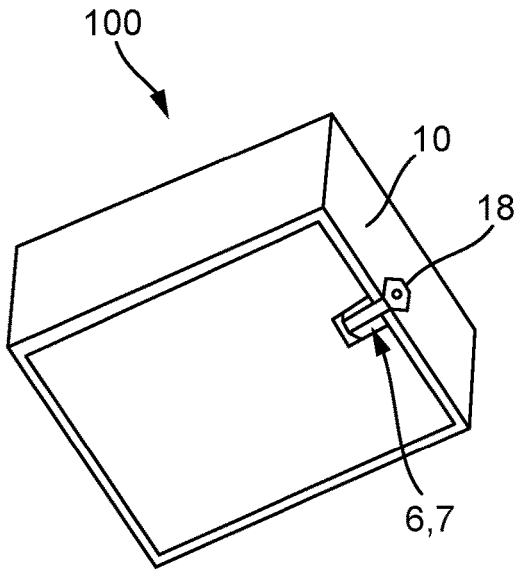
FIG. 3A is a bottom perspective view of an exemplary formliner system.
Figure 3B:
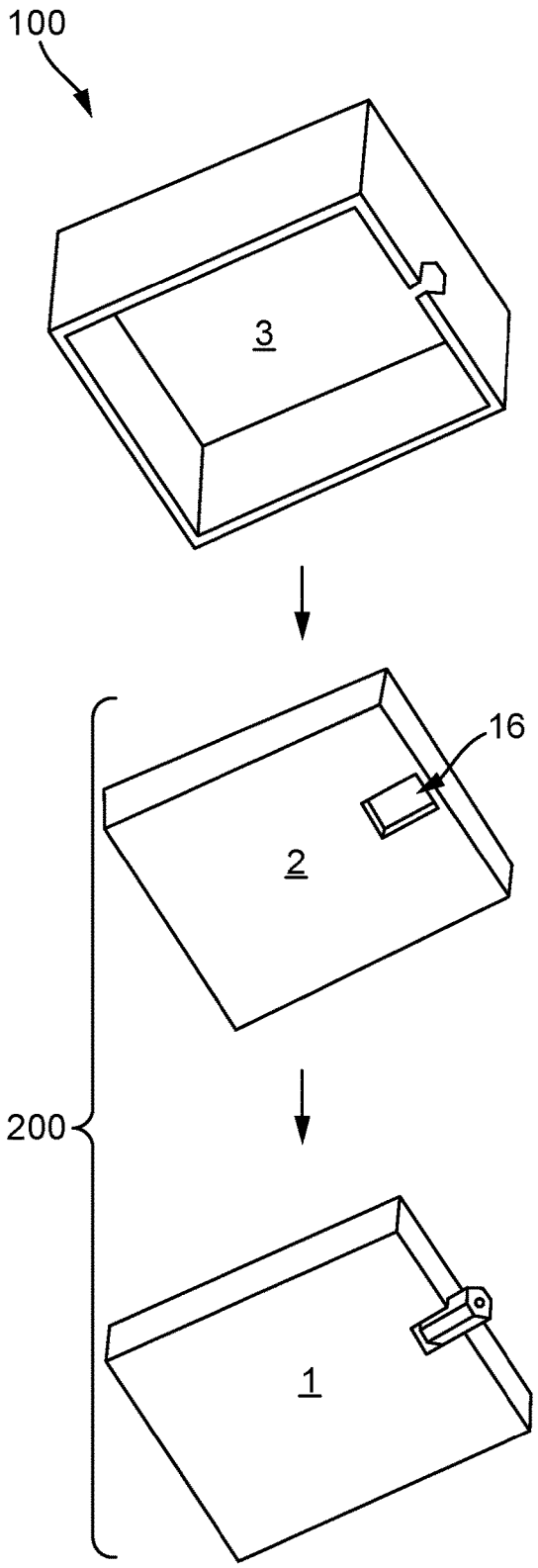
FIG. 3B is an exploded bottom perspective view of the system shown in FIG. 3A.

In order to best fit within a form (not shown) for creating a wall or wall segment and to support the weight of the concrete applied to it when the formliner 100 is in use, in some implementations, the first and second support layers 1, 2 and design layer 3 all have the same length and width so that the dimensions of the formliner 100 are consistent. In other embodiments, the planar support 200 may have dimensions shorter than the design layer 3, such that, for example, when rubber used to form the design layer is poured over the planar support, a portion of the design layer 3 surrounds the perimeter of the planar support 200, covering all or part of the side edges of the planar support 200 (as seen in FIGS. 3A and 3B).

The dimensions may vary based on the desired wall or wall segment to be formed, but exemplary embodiments may advantageously have lengths of eight, twelve, sixteen, twenty or twenty four feet, by way of example only, with widths of four, eight, ten, or twelve feet, all by way of example only. The thickness of the segments of the formliner 100 may depend at least partly on materials of construction and the overall thickness of the wall to be formed using the formliner 100. In some embodiments, the planar support 200 has a thickness of one half inch up to eight inches, with each of the support layers typically between one half and one inch thick.

The carrier 6 integrated into the formliner system 100 includes a sleeve 7 and is positioned such that the sleeve 7 does not extend proud of a perimeter edge 10 of the formliner system 100. This aids in ensuring the formliner 100 can still sit flush against a form when in use for wall construction. In some embodiments, as illustrated in FIGS. 3A, the end 18 of the sleeve 7 proximate to the perimeter edge 10 of the formliner system 100 is flush with the perimeter edge 10 of the formliner system 100. In some implementations, the end 18 of the sleeve 7 proximate to the perimeter edge 10 of the formliner system 100 may be recessed from the perimeter edge 10 of the formliner system 100. In other embodiments, however, a carrier integrated into a formliner system may include a sleeve that extends proud of a perimeter edge of the formliner system, such as when a form to be used for wall construction has a corresponding configuration that allows the sleeve therein.

Figure 4:
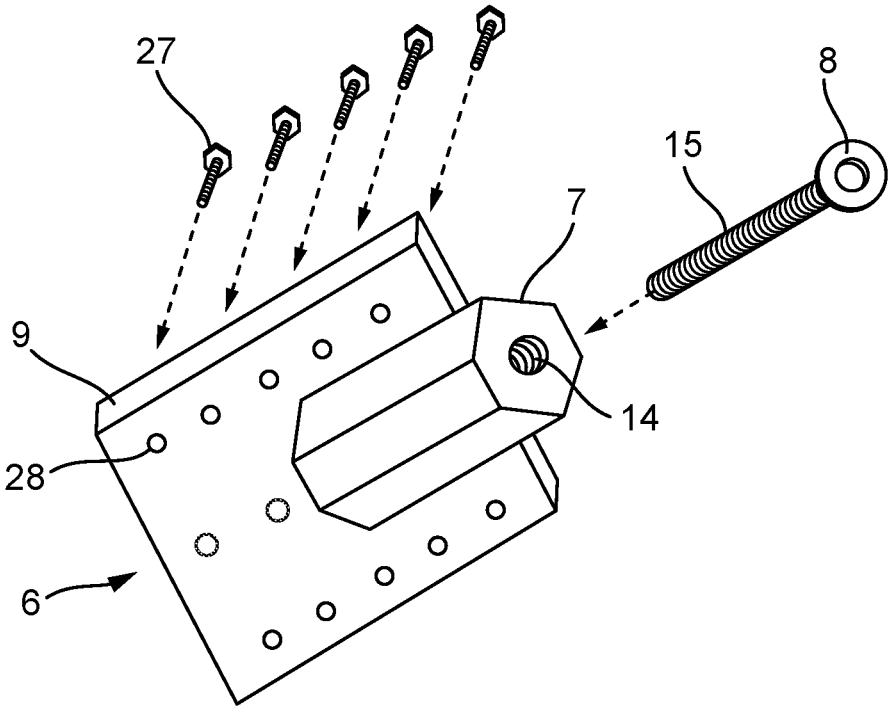
FIG. 4 is an expanded bottom perspective view of the carrier of the system shown in FIG. 3A.
Figure 5A:
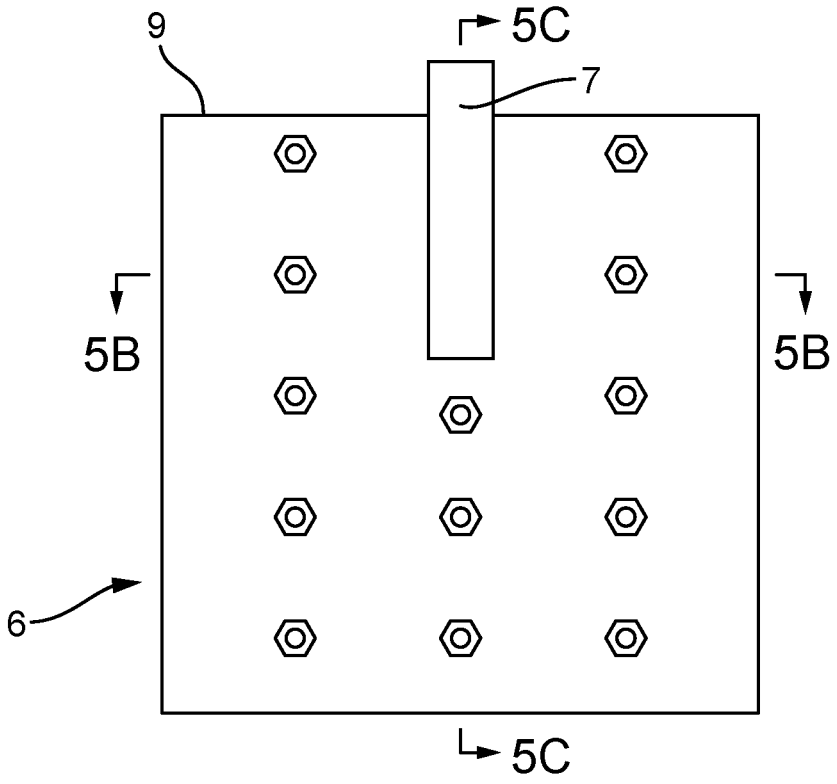
FIG. 5A is a top view of the carrier of the system shown in FIG. 3A.
Figure 5B:
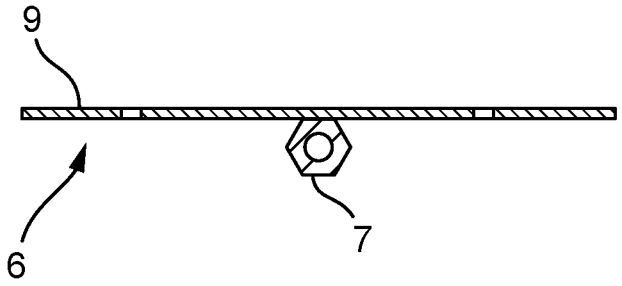
FIG. 5B is a side view of the carrier of the system shown in FIG. 3A.
Figure 5C:
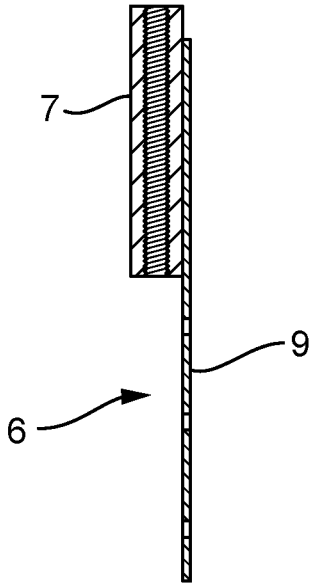
FIG. 5C is a cross section view of the carrier of the system shown in FIG. 3A.

FIG. 4 illustrates one manner in which the sleeve 7 of the carrier 6 is configured to receive a connector 8 such as a fastener or other device that can be used as a connection point. The sleeve 7 may include an internal thread 14 so that the connector 8 may contain threads 15 to removably attach to the sleeve 7 for use in manipulating the formliner 100 before and after use. In one implementation, the connector 8 is an eye bolt, including, but not limited to, nut eye bolts, machinery eye bolts, and screw eye bolts. The eye provides an attachment point for a cable that can be used in safely moving the formliner 100.

Figure 8A:
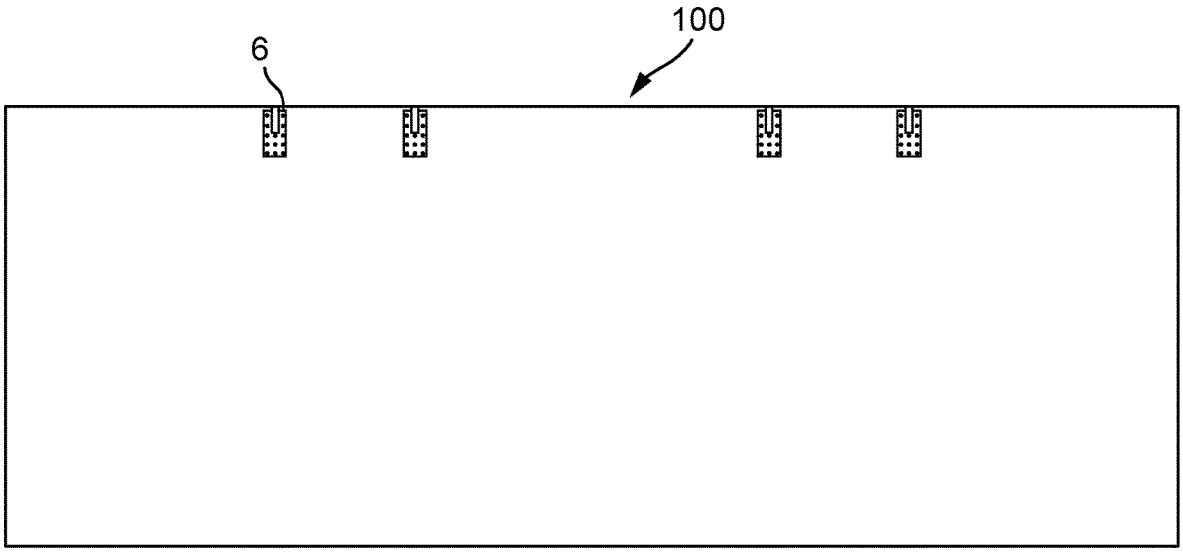
FIG. 8A is a schematic top view of a first support layer of an exemplary formliner systems.
Figure 8B:
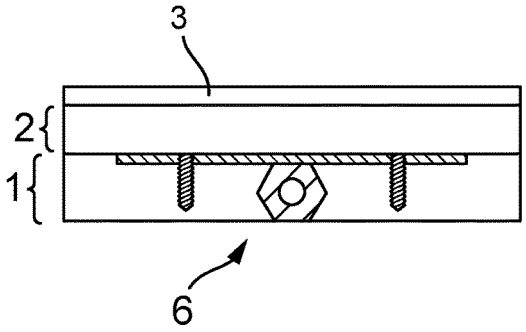
FIG. 8B is a cross section view of the formliner system in FIG. 8A.
Figure 8C:
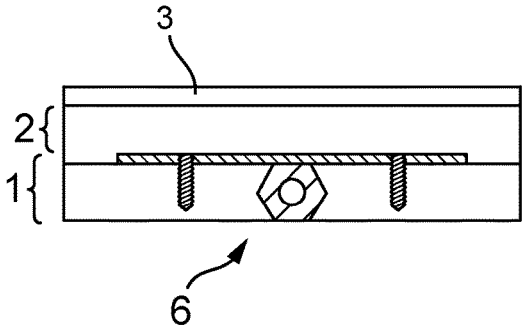
FIG. 8C is a cross section view of another alternative embodiment of a formliner system.

Depending on the size and weight of the formliner 100, two or more carriers 6 may be spaced apart along a same side to provide for a more even weight distribution when the carriers 6 are being used to move the formliner 100 and may be placed on center. It may be desirable only to provide the carriers 6 on a single side edge (e.g., FIG. 8A) so that lifting consistently occurs in the same orientation. Alternatively, it will further be appreciated that one or more carriers 6 can be positioned on other side edges of the formliner 100 so that carriers 6 for lifting the formliner 100 can be accessed from any direction.

As illustrated in FIGS. 4 and 5A-5C, the carrier 6 includes the sleeve 7 and a brace plate 9 to which the sleeve 7 is attached. The brace plate 9 can provide a planar element for more easily attaching the carrier 6 to either or both of the support layers 1, 2. The sleeve 7 and brace plate 9 are advantageously constructed of metal and may be secured to one another by welding. The brace plate 9 has a plurality of apertures 28 for receiving fasteners 27, such as lag bolts, for example, that can be driven into the support layers 1, 2 to connect the carrier 6 thereto. The sleeve 7 may be contained within the area defined by the brace plate 9 or may extend beyond an edge of the brace plate 9. In some embodiments, the brace plate 9 may have, for example, a length of about eight inches and a width of about four inches, and the sleeve 7 may have a length of about four inches. It should be appreciated that other dimensions may be employed.

Figure 6A:
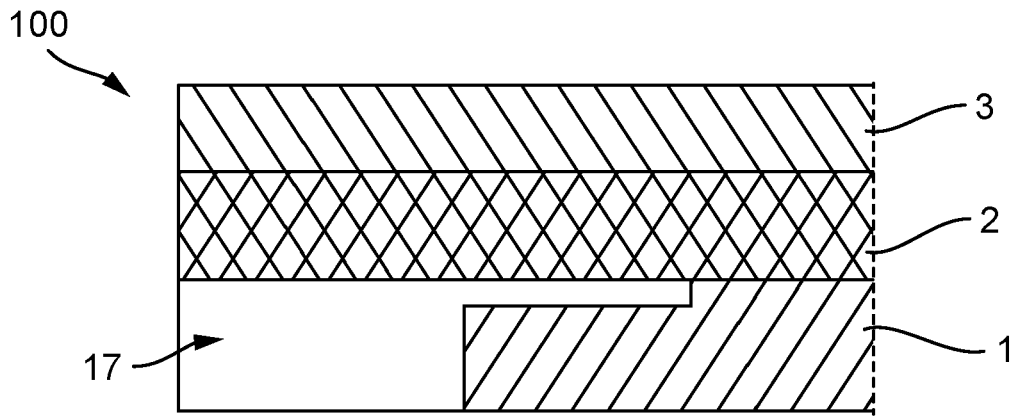
FIGS. 6A-6C are side views of recesses formed in various exemplary embodiments of a formliner system.
Figure 6B:
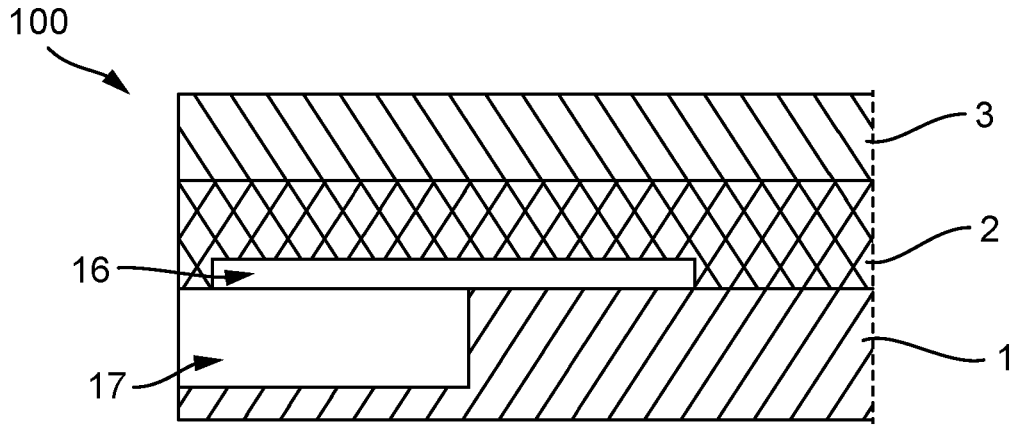
Figure 6C:
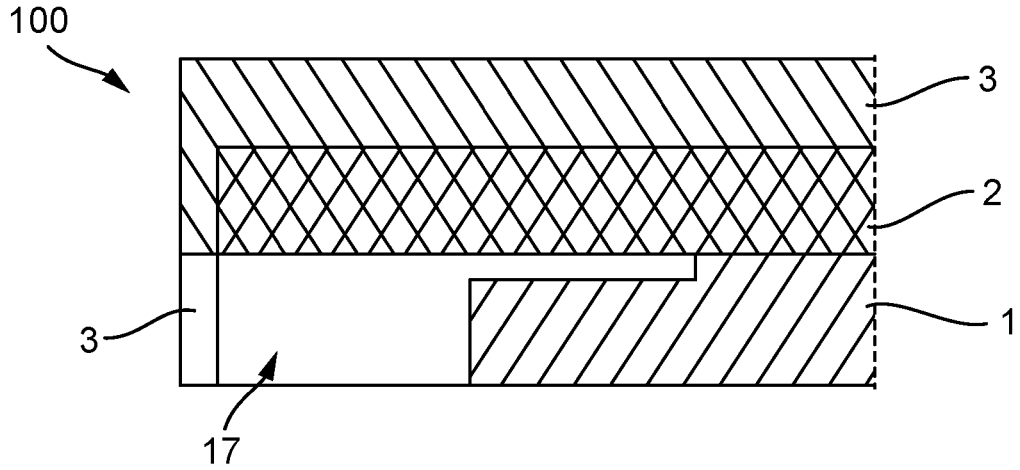
Figure 7A:
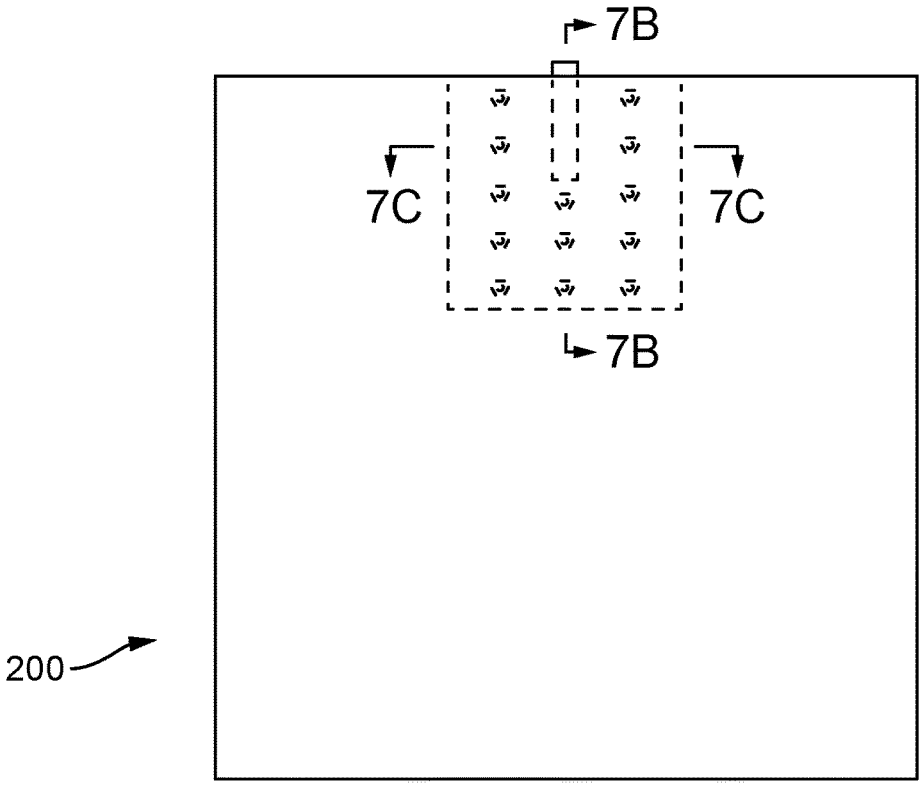
FIG. 7A is a top view of a planar support of an exemplary formliner system.
Figure 7B:
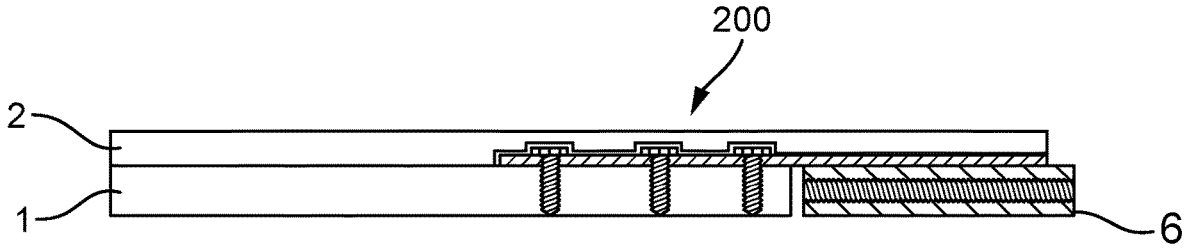
FIG. 7B is a cross section view of the planar support shown in FIG. 7A.
Figure 7C:
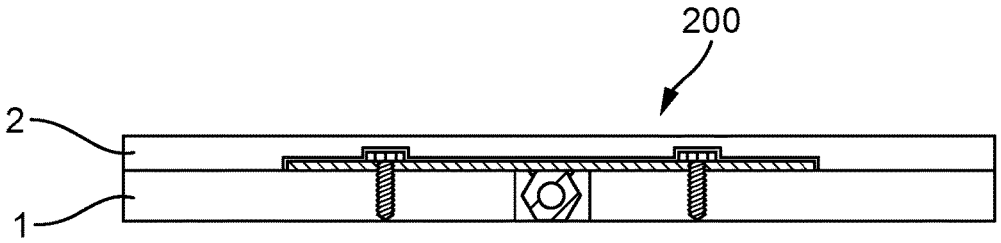
FIG. 7C is another cross section view of the planar support shown in FIG. 7A.

In order to maintain a constant thickness of the formliner 100, the carrier 6 may be attached within a recess formed in the planar support 200, such as in either or both of the first and second support layers 1, 2. The recess may be formed, for example, using a CNC or other router. In one embodiment, as shown in the cross-sectional view of FIG. 6A, a recess 17 is formed entirely within the first support layer 1 and sized to receive both the brace plate 9 and the sleeve 7. In another embodiment, illustrated in FIG. 6B, a recess 16 is formed in the second support layer 2 that matches the dimensions of the brace plate 9 while a recess 17 corresponding to the dimensions of the sleeve 7 is formed in the first support layer 1. The recess 16 in the second support layer 2 may also be formed to account for the heads of fasteners 27 used to secure the brace plate 9 to the first support layer 1. It will be appreciated, however, that the fasteners 27 are preferably countersunk so as to not extend above the brace plate 9 and further that preferably only a single recess is formed in a single support layer 1, 2 to reduce the number of manufacturing operations. FIG. 6C further illustrates that a portion of the recess 17 may extend entirely through the thickness of the first support layer 1 so that the sleeve 7 would be visible on the opposite side of the layer 2, while FIG. 6B shows some portion may remain to support the sleeve 7.

The recesses 16, 17 are preferably formed to minimize the amount of material that needs to be removed from the planar support 200 to receive the carrier 6. Portions removed not taken up by the carrier 6 may leave an increased void within the planar support 200 that may otherwise need to be filled during the manufacturing process to maintain suitable strength levels in the completed formliner 100.

While the invention has been described with reference to a preferred embodiment, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A formliner system comprising:

a planar support comprising at least one support layer;

a design layer comprising a mold, the design layer overlying and attached to the planar support; and a carrier integrated into the planar support, the carrier comprising a sleeve;

wherein the planar support comprises a first support layer and a second support layer overlying and attached to the first support layer, and the carrier is interposed between the first and second support layers, the carrier attached to at least one of the first or second support layers; and wherein the carrier is positioned in a recess of either or both of the first and second support layers.

2. The formliner system of claim 1, wherein the first and second support layers have the same length and width.

3. The formliner system of claim 1, wherein the design layer and first and second support layers all have the same length and width.

4. The formliner system of claim 1, wherein the carrier further comprises a brace plate attached to the sleeve.

5. The formliner system of claim 4, wherein the sleeve has an axial direction, and the sleeve extends beyond a perimeter of the brace plate in the axial direction.

6. The formliner system of claim 4, wherein the brace plate is positioned in a recess formed in the second support layer and attached thereto, and the sleeve is positioned in a recess formed in the first support layer.

7. The formliner system of claim 4, wherein the brace plate is positioned in a recess formed in the first support layer and attached thereto and the sleeve is also positioned in the recess formed in the first support layer.

8. The formliner system of claim 1, wherein the design layer is a rubber mold.

9. The formliner system of claim 1, wherein the formliner system comprises a plurality of carriers disposed along a same side edge of the formliner system.

10. The formliner system of claim 1, wherein the sleeve is configured to receive a connector.

11. The formliner system of claim 10, wherein the sleeve has an internal thread to receive a threaded fastener as the connector.

12. The formliner system of claim 11, wherein the threaded fastener is an eye bolt.

13. The formliner system of claim 1, wherein the carrier is positioned such that the sleeve does not extend beyond a perimeter edge of the formliner system.

14. The formliner system of claim 13, wherein an end of the sleeve is flush with the perimeter edge of the formliner system.

15. The formliner system of claim 13, wherein an end of the sleeve is recessed from the perimeter edge of the formliner system.

16. A formliner system comprising:

a first support layer;

a second support layer overlying and attached to the first support layer;

a design layer comprising a rubber mold, the design layer overlying and attached to the second support layer; and a carrier interposed between the first and second support layers, the carrier attached to at least one of the first or second support layers, the carrier comprising a sleeve configured to receive a connector and a brace plate attached to the sleeve, wherein the carrier is positioned such that the sleeve does not extend beyond a perimeter edge of the formliner system, the carrier positioned in a recess formed in either one or both of the first and second support layers.

17. A method of creating a formliner system comprising:

(i) providing a first support layer, a second support layer, and a carrier comprising a sleeve configured to receive a connector;

(ii) securing the carrier in a recess formed in the first support layer;

(iii) attaching the second support layer overlying the first support layer to form a planar support such that the carrier is interposed between the first and second support layers; and (iv) forming a mold as a design layer overlying the planar support.

18. The method of claim 17, wherein the sleeve does not extend beyond a perimeter edge of the formliner system.

* * * * *